US009059491B2

(12) United States Patent
Lim et al.

(10) Patent No.: US 9,059,491 B2
(45) Date of Patent: Jun. 16, 2015

(54) DOUBLE MICROSTRIP TRANSMISSION LINE HAVING COMMON DEFECTED GROUND STRUCTURE AND WIRELESS CIRCUIT APPARATUS USING THE SAME

(75) Inventors: Jongsik Lim, Daejeon (KR); Dal Ahn, Chungcheongnam-do (KR)

(73) Assignee: Soonchunhyang University Industry Academy Cooperation Foundation, Chungcheongnam-do (KR)

( * ) Notice: Subject to any disclaimer, the term of this patent is extended or adjusted under 35 U.S.C. 154(b) by 428 days.

(21) Appl. No.: 13/267,152

(22) Filed: Oct. 6, 2011

(65) Prior Publication Data

US 2012/0112857 A1 May 10, 2012

(30) Foreign Application Priority Data

Nov. 10, 2010 (KR) ..... 10-2010-0111367

(51) Int. Cl.

| | |
|---|---|
| ***H01P 3/08*** | (2006.01) |
| ***H01P 5/02*** | (2006.01) |
| ***H01P 1/203*** | (2006.01) |
| ***H01P 5/16*** | (2006.01) |
| ***H01P 5/18*** | (2006.01) |

(52) U.S. Cl.

CPC ..... *H01P 3/081* (2013.01); *H01P 3/088* (2013.01); *H01P 5/028* (2013.01); *H01P 1/2039* (2013.01); *H01P 3/082* (2013.01); *H01P 5/16* (2013.01); *H01P 5/184* (2013.01); *H01P 5/185* (2013.01)

(58) Field of Classification Search

CPC ..... H01P 3/08; H01P 3/082; H01P 3/088; H01P 5/022; H01P 5/028

USPC ..... 333/33, 246

See application file for complete search history.

(56) References Cited

U.S. PATENT DOCUMENTS

| | | | | |
|---|---|---|---|---|
| 2001/0033211 | A1* | 10/2001 | Nakada | 333/246 |
| 2004/0119565 | A1* | 6/2004 | Shirasaki | 333/246 |
| 2005/0035825 | A1* | 2/2005 | Carson | 333/117 |
| 2010/0097163 | A1* | 4/2010 | Shin et al. | 333/219 |

* cited by examiner

*Primary Examiner* — Benny Lee

(74) *Attorney, Agent, or Firm* — Dickstein Shapiro LLP

(57) ABSTRACT

Disclosed are a microstrip transmission line having a common defected ground structure (DGS) and a wireless circuit apparatus having the same. The microstrip transmission line realizes a common defected ground structure (DGS) and a double microstrip structure, and includes: a first dielectric layer; a first signal line pattern formed on a first surface of the first dielectric layer; a common ground conductive layer formed on a second surface of the first dielectric layer and having a defected ground structure, the first surface facing the second surface; a second dielectric layer having a first surface brought into contact with the common ground conductive layer, and facing the first dielectric layer while interposing the common ground conductive layer between the first dielectric layer and the second dielectric layer; and a second signal line pattern formed on a second surface of the second dielectric layer, the first surface facing the second surface.

1 Claim, 17 Drawing Sheets

DOUBLE MICROSTRIP TRANSMISSION LINE HAVING COMMON DEFECTED GROUND STRUCTURE AND WIRELESS CIRCUIT APPARATUS USING THE SAME

CROSS-REFERENCE TO RELATED APPLICATION

This application claims priority to Korean Patent Application No. 10-2010-0111367, filed on Nov. 10, 2010, and all the benefits accruing therefrom under 35 U.S.C. §119, the contents of which in its entirety are herein incorporated by reference.

BACKGROUND

1. Field

The present disclosure relates to a microstrip transmission line, and more particularly, to a microstrip transmission line having a common defected ground structure and a wireless circuit apparatus having the same.

2. Description of the Related Art

A representative transmission line structure, which is widely used for forming circuits and parts for wireless communication of a radio frequency (RF) and microwave band, is a microstrip transmission line. The microstrip transmission line is manufactured from a printed circuit board (PCB) as illustrated in FIG. 1*a* and has a planar structure. The structure of the printed circuit board as illustrated in FIG. 1*a* is well known in the art, and includes metal conductive layers 30 and 50 which are coated at both sides of a dielectric layer 10 with a relative permittivity $\in_r$ and a thickness H, wherein each of the metal conductive layers 30 and 50 has a thickness T.

Referring to FIG. 1*b*, by removing the metal conductive layer 30 except for a transmission line 40, only the transmission line 40 with a predetermined line impedance Zo and a line width W1 remains on the dielectric layer 10 of FIG. 1*a*. The widely coated lower metal conductive layer 50 serves as a ground surface.

Although not shown in the drawings, in the structure of the microstrip transmission line, a defected ground structure (DGS) is formed in the ground surface generally through an etching process. The defected ground structure (DGS) is inserted, so that the length of the microstrip transmission line can be reduced, resulting in a reduction of the size of a wireless circuit through the application of the defected ground structure (DGS).

However, although the defected ground structure (DGS) is inserted into the ground surface, since there is a limitation in reducing the length of the microstrip transmission line while maintaining desired electrical performance, it is difficult to improve the degree of integration by minimizing the length of the microstrip transmission line or reducing the size of the wireless circuit without performance deterioration.

SUMMARY OF THE INVENTION

The present disclosure is directed to providing a microstrip transmission line with a novel structure, which may improve the degree of integration by minimizing the length of the microstrip transmission line in a circuit design, and significantly reducing the sizes of various wireless circuits using the structure of the microstrip transmission line.

In one aspect, there is provided a microstrip transmission line including: a first dielectric layer; a first signal line pattern formed on a first surface of the first dielectric layer; a common ground conductive layer formed on a second surface of the first dielectric layer and having a defected ground structure (DGS), the first surface facing the second surface; a second dielectric layer having a first surface brought into contact with the common ground conductive layer, and facing the first dielectric layer while interposing the common ground conductive layer between the first dielectric layer and the second dielectric layer; and a second signal line pattern formed on a second surface of the second dielectric layer, the first surface facing the second surface.

The first signal line pattern and the second signal line pattern may be electrically connected to each other through a signal via hole formed by passing through the first dielectric layer and the second dielectric layer.

A ground window may be formed on the common ground conductive layer, and indicate an area formed by removing a peripheral portion of the signal via hole from a common ground conductive surface such that the signal via hole connects only the first signal line pattern and the second signal line pattern to each other while being prevented from being brought into contact with the common ground conductive layer.

The defected ground structure (DGS) of the common ground conductive layer may be formed by removing a pattern having a geometrical shape from the common ground conductive layer, the pattern including two defected areas and a connecting slot for connecting the two defected areas to each other, and one or more defected ground structures (DGSs) may be formed on the common ground conductive layer.

In the defected ground structure (DGS) of the common ground conductive layer, shapes, sizes and positions of the two defected areas may be symmetrical or asymmetrical to each other.

In another aspect, there is provided a wireless circuit apparatus including: a first microstrip transmission line including a first dielectric layer, a first signal line pattern formed on a first surface of the first dielectric layer, and a first bottom ground conductive layer formed on a second surface of the first dielectric layer, the first surface facing the second surface; and a second microstrip transmission line including a second dielectric layer, a second signal line pattern formed on a first surface of the second dielectric layer, and a second bottom ground conductive layer formed on a second surface of the second dielectric layer, the first surface facing the second surface, wherein the first bottom ground conductive layer and the second bottom ground conductive layer are butted against each other to form a common ground conductive layer, and a partial area of the common ground conductive layer is removed in a geometrical pattern to form one or more defected ground structures (DGSs).

The wireless circuit apparatus may have a double microstrip transmission line structure by designing a circuit layout with a single layer board structure provided on a bottom ground surface thereof with the defected ground structure (DGS), and allowing the designed circuit layout to be folded in half to change the single layer board structure into a double board structure provided on a common ground surface thereof with the defected ground structure (DGS).

BRIEF DESCRIPTION OF THE DRAWINGS

The above and other aspects, features and advantages of the disclosed exemplary embodiments will be more apparent from the following detailed description taken in conjunction with the accompanying drawings in which.

DETAILED DESCRIPTION OF THE INVENTION

Figure 1A:
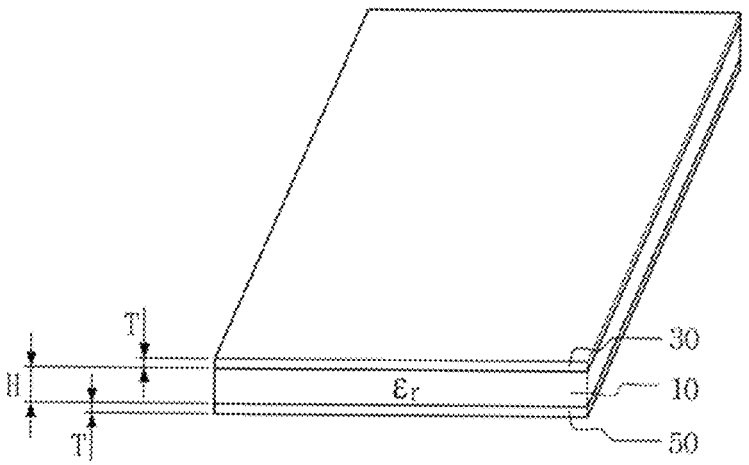
FIG. 1A (PRIOR ART)
FIGS. 1*a* and 1*b* are upper perspective views illustrating the structure of a conventional planar printed circuit board.
Figure 1B:
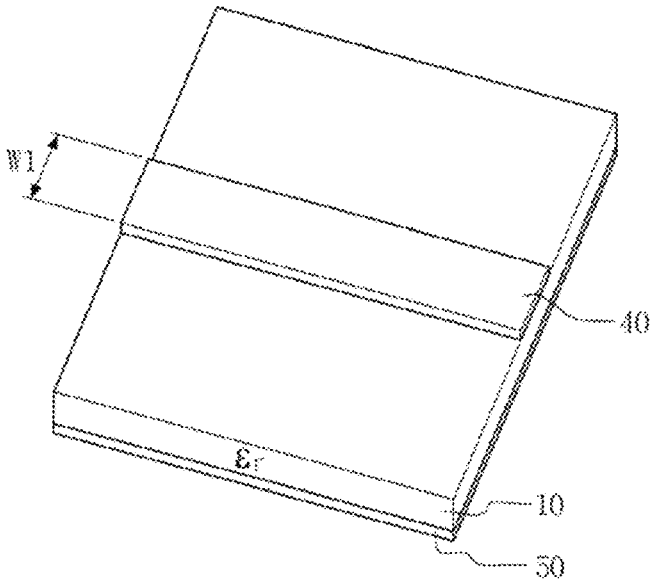
FIG. 1B (PRIOR ART)

Exemplary embodiments now will be described more fully hereinafter with reference to the accompanying drawings, in which exemplary embodiments are shown. The present disclosure may, however, be embodied in many different forms and should not be construed as limited to the exemplary embodiments set forth therein. Rather, these exemplary embodiments are provided so that the present disclosure will be thorough and complete, and will fully convey the scope of the present disclosure to those skilled in the art. In the description, details of well-known features and techniques may be omitted to avoid unnecessarily obscuring the presented embodiments.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms "a", "an", etc. does not denote a limitation of quantity, but rather denotes the presence of at least one of the referenced item. The use of the terms "first", "second", and the like does not imply any particular order, but they are included to identify individual elements. Moreover, the use of the terms "first", "second", etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals denote like elements. The shape, size and regions, and the like, of the drawing may be exaggerated for clarity.

Hereinafter, a microstrip transmission line according to preferred embodiments of the disclosure will be described in detail by referring to the accompanying drawings.

One embodiment of the disclosure proposes that a common defected ground structure (DGS) and a double microstrip transmission line structure are appropriately combined with each other in order to improve the degree of integration by significantly reducing the length of the microstrip transmission line and the size of a wireless circuit.

Figure 2A:
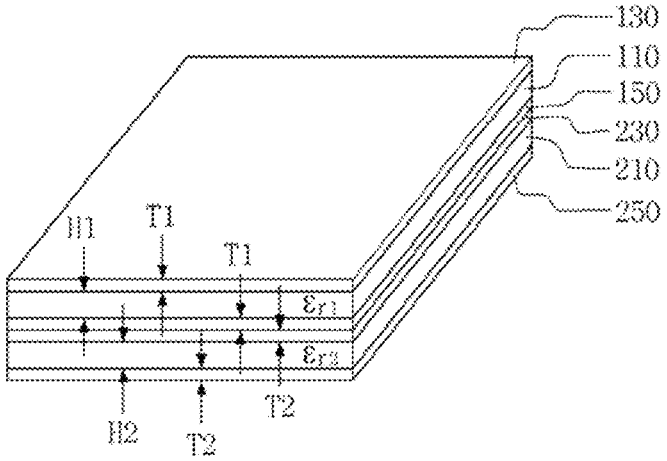
FIGS. 2*a* to 2*c*, 3*a* and 3*b*, 4*a* to 4*c*, and 5*a* to 5*f* are diagrams illustrating the basic structures to be applied to one embodiment of the disclosure through a combination.
Figure 2B:
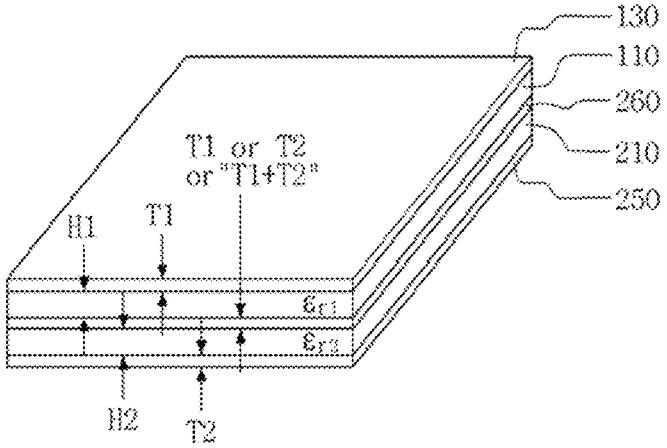
Figure 2C:
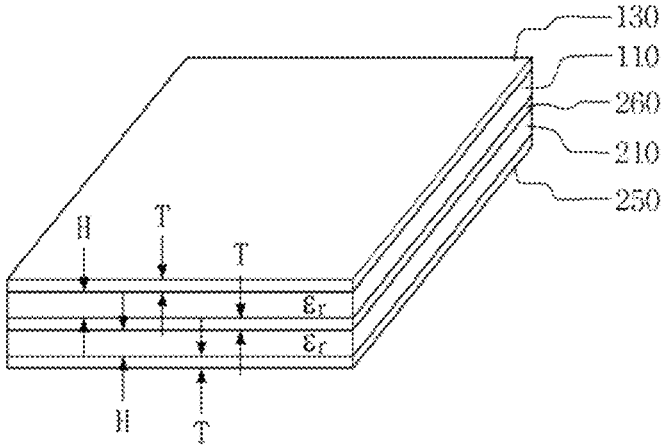
Figure 3A:
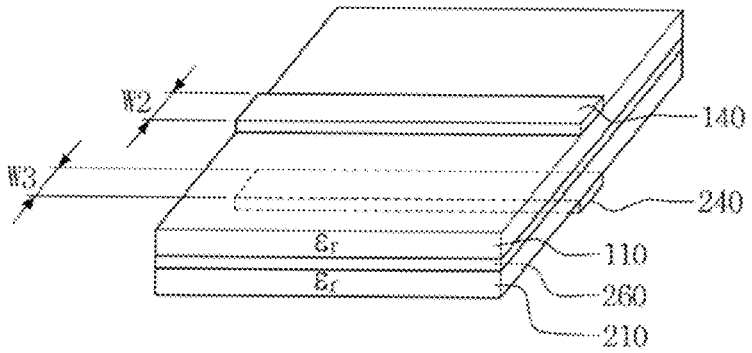
Figure 3B:
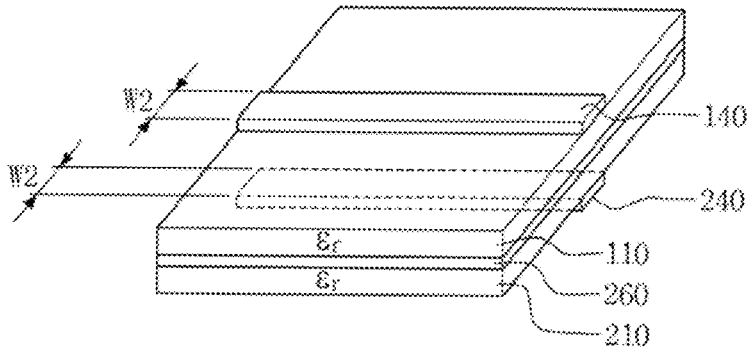
Figure 4A:
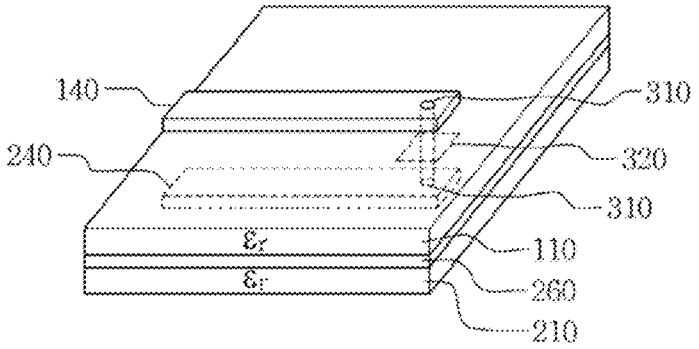
Figure 4B:
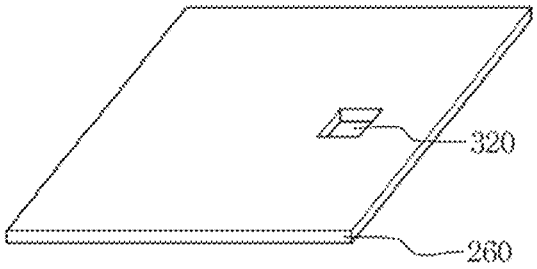
Figure 4C:
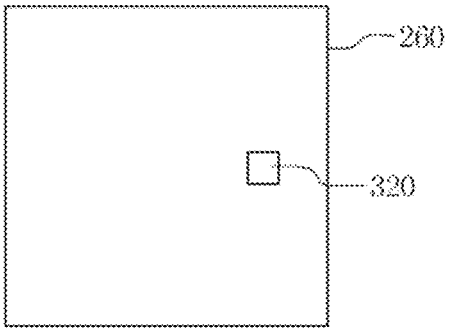

FIGS. 2*a* to 2*c*, 3*a* and 3*b*, 4*a* to 4*c*, and 5*a* to 5*f* are diagrams illustrating the basic structures to be applied to one embodiment of the disclosure through a combination. In detail, FIGS. 2*a* to 2*c* illustrate a double board structure distinguished from a single board structure, and FIGS. 3*a* and 3*b* illustrate double microstrip transmission line structure. FIGS. 4*a* to 4*c* illustrate the configuration of a signal via hole 310 and a ground window 320, and FIGS. 5*a* to 5*f* illustrate the configuration of a common defected ground structure (DGS).

FIG. 2*a* illustrates a structure in which two printed circuit boards are butted against each other. In principal, relative permitivities and thicknesses of dielectrics and thicknesses of metal conductors between the two boards may be different from each other. Thus, the relative permitivities of dielectric layers 110 and 210 are indicated by $\in_{r1}$ and $\in_{r2}$, the thicknesses of the dielectric layers 110 and 210 are indicated by H1 and H2, and the thicknesses of conductive layers 130, 150, 230 and 250 are indicated by T1 and T2.

The same effect is obtained even when any one of the bottom ground conductive layers 150 and 230, which are brought into contact with each other, is removed. When the upper bottom ground conductive layer 230 on the lower board, which is brought into contact with the upper board, is removed, the thickness of a remaining conductive layer 260 is T1 as illustrated in FIG. 2*b*. Meanwhile, when the lower bottom ground conductive layer 150 on the upper board, which is brought into contact with the lower board, is removed, the thickness of the remaining conductive layer 260 is T2. When the bottom ground conductive layer is not removed, the thickness of the conductive layer 260 is 'T1+T2'. However, since the T1 or T2 is thinner than H1 or H2 by several tens of times to several hundreds of times, even if the thickness of the conductive layer 260 is 'T1+T2', the 'T1+T2' is also very thinner than the H1 or H2. Thus, no problem occurs even if the thickness of the conductive layer 260 is recognized as the thickness T1 or T2 of one layer.

FIG. 2*c* illustrates the case in which the same two printed circuit boards are used and one of conductive layers on a bonding surface between the two boards has been removed. In FIG. 2*c*, the dielectric layers 110 and 210 have the same relative permittivity $\in_r$ and thickness H, and the conductive layers 130, 250 and 260 also have the same thickness T.

FIGS. 3*a* and 3*b* illustrate the structure of a double microstrip transmission line provided at both sides thereof with upper and lower transmission lines based on the common ground conductive layer 260 in the structure of FIG. 2*c*. Signal line patterns 140 and 240 denote signal lines of the upper and lower transmission lines. The two signal lines may have line widths W2 and W3 different from each other as illustrated in FIG. 3*a*, and may have the same line width W2 as illustrated in FIG. 3*b*.

FIG. 4*a* illustrates one or more signal via holes 310 formed in order to connect the upper and lower transmission lines, which are formed based on the common ground conductive layer 260, to each other. For the purpose of convenience, FIG. 4*a* illustrates only one signal via hole 310. Since the signal via hole 310 is used to transfer an electromagnetic wave signal from the upper signal line pattern 140 to the lower signal line pattern 240, the signal via hole 310 is prevented from being brought into contact with the common ground conductive layer 260.

Thus, a ground window 320 is formed around the signal via hole 310 as illustrated in FIG. 4*b* such that the signal via hole 310 connects only the signal line patterns 140 and 240 to each other by passing through the two dielectric layers 110 and 210 as illustrated in FIG. 4a. In order to form the ground window 320, it is necessary to remove patterns having various geometric shapes from the common ground conductive layer 260 through an etching process. The one embodiment illustrates the ground window 320 having a rectangular shape for the purpose of convenience. However, the ground window 320 may have various geometric shapes such as a circular shape, a polygonal shape (N-polygonal shape, N=3, 4, 5, 6, . . . ), a spiral shape, a fan shape, a zigzag shape, a doughnut shape or a figure of 8 shape (a groundnut shape or a snowman shape). FIG. 4c simply illustrates the common ground conductive layer 260 and the ground window 320 formed in the common ground conductive layer 260 to pass through the signal via hole for the purpose of convenience.

Figure 5A:
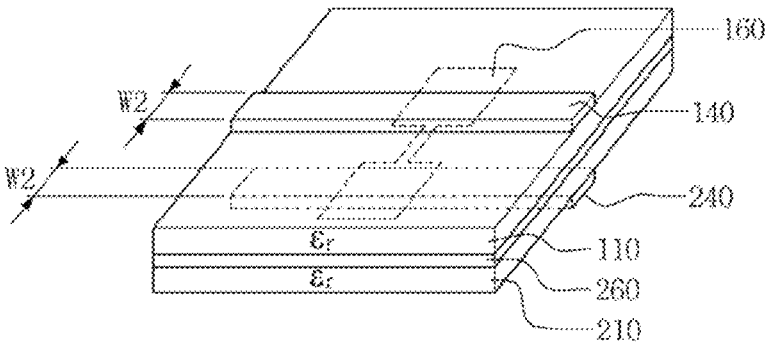
Figure 5B:
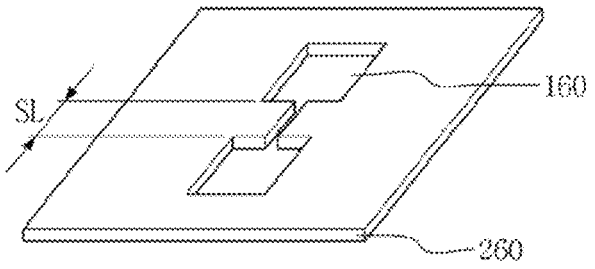
Figure 5C:
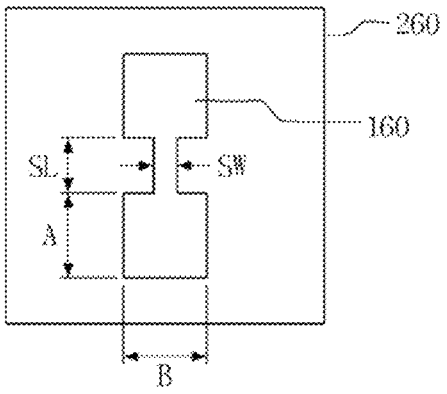

FIG. 5a illustrates a structure in which one or more defected ground structures (DGSs) 160 have been inserted into the common ground conductive layer 260 in the double microstrip transmission line structure illustrated in FIG. 3a or 3b. FIG. 5b illustrates a structure in which the defected ground structure (DGS) 160 has been formed by removing an area with a predetermined pattern from the common ground conductive layer 260 through an etching process. FIG. 5c simply illustrates the defected ground structure (DGS) 160 formed in the common ground conductive layer 260 for the purpose of convenience. A and B denote measures of both defected areas of the defected ground structure (DGS) 160, and SL and SW denote the length and width of a connecting slot which connects the two defected areas to each other.

FIGS. 5a to 5c illustrate a dumbbell-shaped defected ground structure (DGS) 160 having a rectangular defected area. However, it is natural that the pattern of the defected ground structure (DGS) 160 is not limited thereto. For example, the defected area in the dumbbell-shaped defected ground structure (DGS) 160 may have various geometric shapes such as a polygonal shape (N-polygonal shape, N=3, 4, 5, 6, . . . ), other than a rectangular shape, or a spiral shape, wherein the polygonal shape includes a circular shape, a triangular shape, a hexagonal shape, an octagonal shape, a decagonal shape and the like. Furthermore, the entire structure of the dumbbell-shaped defected ground structure (DGS) 160 may have various shapes of geometric patterns such as a polygonal shape (N-polygonal shape, N=3, 4, 5, 6, . . . ) or a spiral shape, other than the dumbbell-shape, wherein the polygonal shape includes a rectangular shape, a circular shape, a triangular shape, a hexagonal shape, an octagonal shape, a decagonal shape and the like.

Figure 5D:
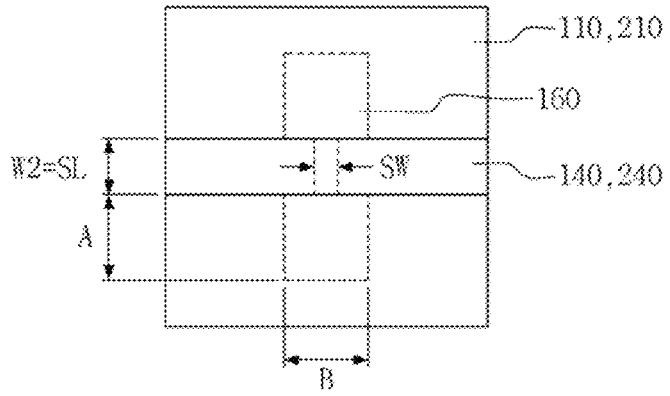
Figure 5E:
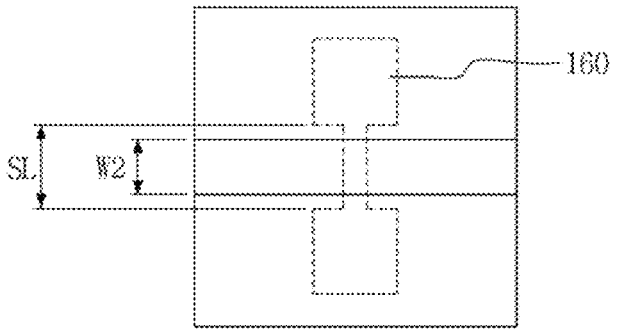
Figure 5F:
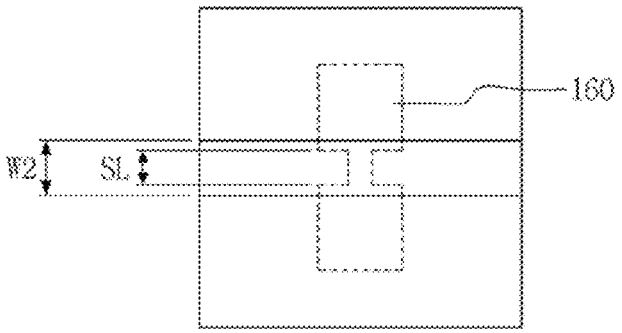

In FIG. 5a, the signal line patterns 140 and 240 of the two microstrip transmission lines have the same width W2. However, the signal line patterns 140 and 240 may have widths W2 and W3 different from each other. Furthermore, the length SL (FIGS. 5b, 5c) of the connecting slot may be equal to each other or different from each other. That is, the length SL of the connecting slot may be equal to the line width W2 of the double microstrip transmission line as illustrated in FIG. 5d, may be larger than the W2 as illustrated in FIG. 5e, or may be smaller than the W2 as illustrated in FIG. 5f.

A circuit network having three ports, four ports and the like may be formed using the structure of FIG. 5a. The defected ground structure (DGS) 160 is commonly applied to the upper and lower microstrip transmission lines, thereby reducing the physical lengths while maintaining substantially the same electrical lengths of the microstrip transmission lines. Consequently, the defected ground structure (DGS) 160 may be used for designing a wireless circuit apparatus with a reduced length while having a vertical combination structure.

The basic structures described in FIGS. 2a to 2c, 3a and 3b, 4a to 4c, and 5a to 5f are combined with each other, thereby realizing the technical idea of the one embodiment employing the defected ground structure (DGS) and the double microstrip transmission line structure.

Figure 6A:
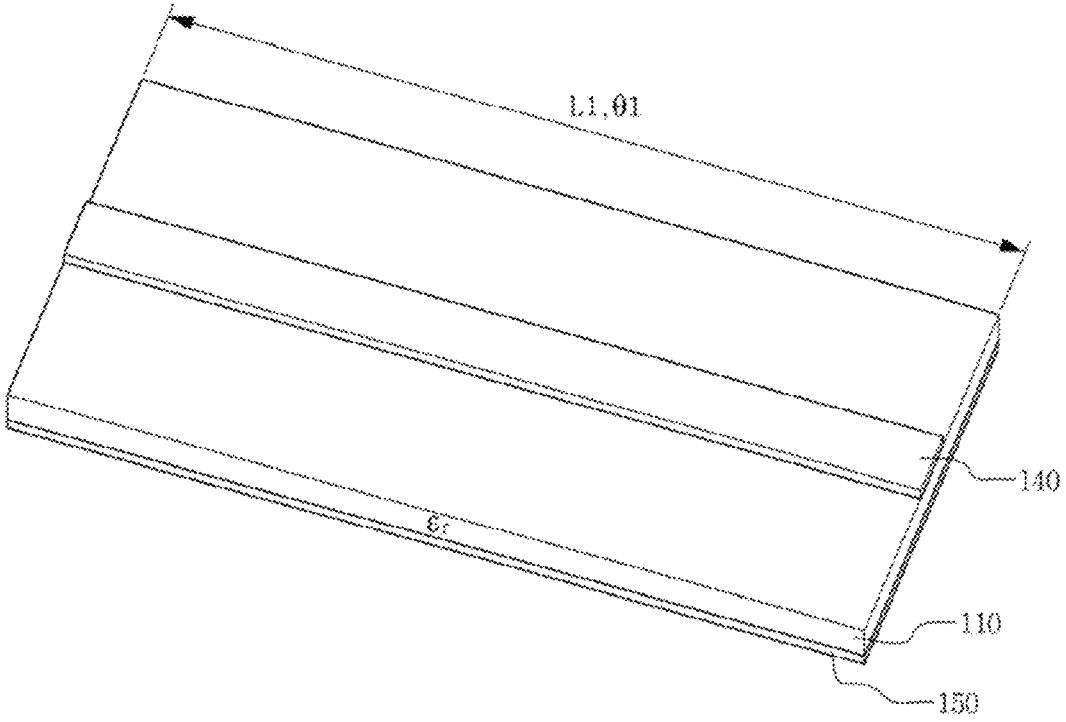
FIGS. 6*a* and 6*b* are diagrams illustrating the effect of a defected ground structure (DGS) to be applied to one embodiment of the disclosure.
Figure 6B:
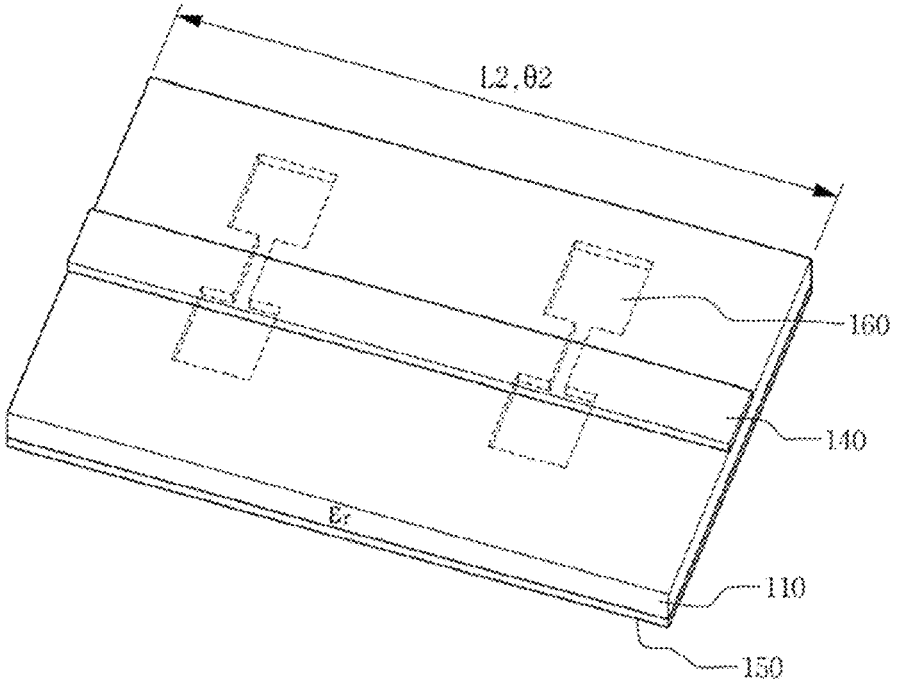

Referring to FIGS. 6a and 6b, it is possible to reduce the length of the microstrip transmission line by employing the defected ground structure (DGS), and improve the degree of integration by reducing the size of a wireless circuit through the application of the defected ground structure (DGS).

FIG. 6a illustrates a standard microstrip transmission line having a physical length L1 and an electrical length θ1 at a predetermined frequency, and FIG. 6b illustrates the effect of the defected ground structure (DGS) 160. One or more the defected ground structures (DGSs) 160 are inserted into the ground surface of the microstrip transmission line, so that the physical length is reduced (that is, L2<L1), and the electrical length is maintained to be approximately the same (that is, θ2≈θ1), resulting in a reduction of the overall size of the circuit.

As illustrated in FIGS. 6a and 6b, it is possible to reduce the size of the circuit by inserting one or more defected ground structures (DGSs) 160 into the microstrip transmission line of a single layer board. However, a limitation still exists because the microstrip transmission line has a planar structure. As compared with this, as illustrated in FIG. 7a, the microstrip transmission line is folded in half, and the defected ground structure (DGS) is three-dimensionally formed on a common ground surface to be commonly applied to upper and lower microstrip transmission lines, so that the physical size of the circuit may be significantly reduced.

Figure 7A:
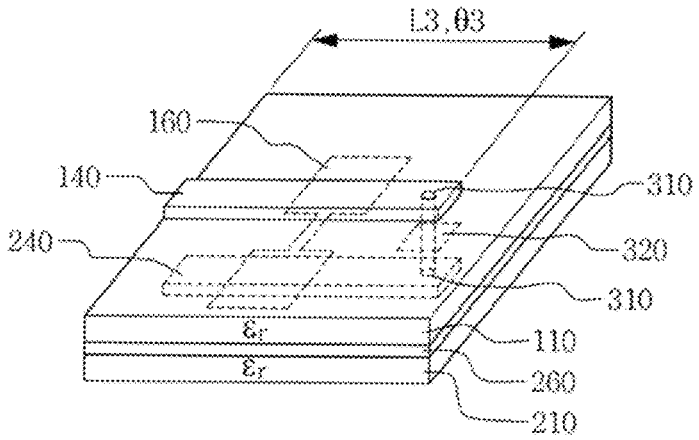
FIGS. 7*a* to 7*c* are diagrams illustrating the structure of a double microstrip transmission line having a common defected ground structure (DGS) according to one embodiment of the disclosure.

FIG. 7a illustrates the case in which one or more defected ground structures (DGSs) 160 are inserted into the common ground conductive layer 260 in the double the microstrip transmission line structure as illustrated in FIGS. 3a and 3b, and one or more signal via holes 310 are formed in order to connect the signal line patterns 140 and 240, which are positioned on the upper and lower microstrip transmission lines, to each other.

The microstrip transmission line of one embodiment includes an upper dielectric layer 110, an upper signal line pattern 140, a common ground conductive layer 260, a lower dielectric layer 210, and a lower signal line pattern 240. The signal line pattern 140 is formed on one surface of the upper dielectric layer 110. The common ground conductive layer 260 is formed on the other surface of the upper dielectric layer 110 and has the defected ground structure (DGS). The lower dielectric layer 210 has one surface brought into contact with the common ground conductive layer 260 and faces the upper dielectric layer 110 while interposing the common ground conductive layer 260 therebetween. The lower signal line pattern 240 is formed on the other surface of the lower dielectric layer 210.

Figure 7B:
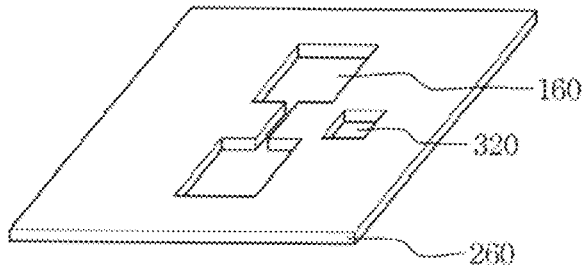

The upper and lower signal line patterns 140 and 240 may be electrically connected to each other through the signal via hole 310 formed by passing through the upper dielectric layer 110 and the lower dielectric layer 210. Since it is necessary to prevent the signal via hole 310 from being brought into contact with the common ground conductive layer 260, a conductive portion corresponding to a ground window 320 is removed from the common ground conductive layer 260 as illustrated in FIG. 7b through an etching process such that the signal via hole 310 may pass through the upper and lower dielectric layers 110 and 210. FIG. 7b illustrates the common ground conductive layer 260 provided with the defected ground structure (DGS) 160 and the ground window 320, and FIG. 7c simply illustrates the ground window 320 for a signal via hole and the defected ground structure (DGS) 160, which have been formed on the common ground conductive layer 260, for the purpose of convenience.

Figure 7C:
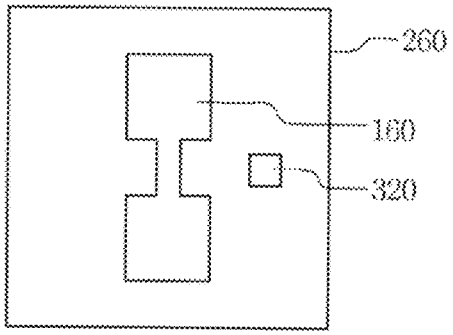

Referring to FIGS. 7*b* and 7*c*, the ground window 320 is formed on the common ground conductive layer 260. The ground window 320 indicates an area formed by etching a peripheral portion of the signal via hole 310 from a common ground conductive surface such that the signal via hole 310 may connect only the upper and lower signal line patterns 140 and 240 to each other while being prevented from being brought into contact with the common ground conductive layer 260. The defected ground structure 160 is formed by removing a pattern having a geometrical shape from the common ground conductive layer 260 through an etching process, wherein the pattern includes two defected areas and a connecting slot for connecting the defected areas to each other. One or more defected ground structures 160 are formed on the common ground conductive layer 260, and the shapes, sizes and positions of the defected areas may be symmetrical or asymmetrical to each other.

The double microstrip transmission line structure as illustrated in FIG. 7*a* leads to the improvement of the degree of integration using one or more defected ground structures (DGSs) 160 and one or more signal via holes 310. For example, when the microstrip transmission line of a single layer board, which includes two defected ground structures (DGSs) 160 and has a physical length L2 as illustrated in FIG. 6*b*, is folded in half to form the double board as illustrated in FIG. 7*a*, since L3 and θ3 correspond to approximately a half of L2 and θ2 as illustrated in FIG. 6*b*, the physical size of the circuit may be significantly reduced and the degree of integration of the circuit may be significantly improved.

Hereinafter, a wireless circuit apparatus including the microstrip transmission line according to preferred embodiments of the disclosure will be described in detail by referring to the accompanying drawings.

The above-mentioned defected ground structure (DGS) and the double microstrip transmission line structure may be applied to various wireless circuit apparatuses such as wireless communication circuits of a radio frequency (RF) and microwave band. For the purpose of convenience, in relation to a printed circuit board including a circuit, it is assumed that the thickness of a dielectric is 31 mils (1 mil=0.001 inch) when the dielectric has a relative permittivity of 2.2 and has a single layer structure.

Wireless circuit apparatuses, which will be described later, employ a double microstrip transmission line structure in which bottom ground surfaces of two microstrip transmission lines are butted against each other to form the common ground conductive layer 260, and a partial area is removed in a geometrical pattern from the common ground conductive layer 260 of a common ground surface through an etching process, thereby forming one or more defected ground structures (DGSs). After a circuit layout with a single layer board structure provided on the bottom ground surface thereof with the defected ground structure (DGS) is designed, the designed circuit layout is folded in half to change the single layer board structure into a double board structure provided on the common ground surface thereof with the defected ground structure (DGS), thereby achieving the double microstrip transmission line structure.

Figure 8A:
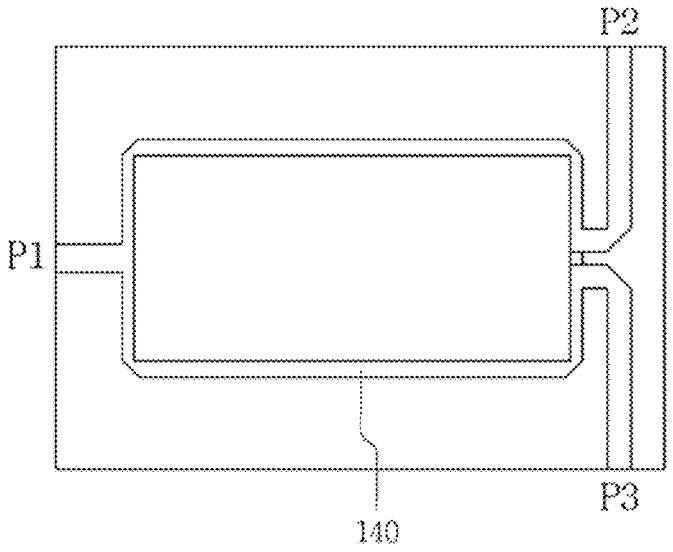
FIGS. 8*a* to 8*d*, 9*a* to 9*d*, 10*a* to 10*c*, 11 a to 11*c*, and 12*a* to 12*c* are exemplary diagrams of wireless circuit apparatuses according to embodiments of the disclosure.

FIG. 8*a* illustrates a Wilkinson power divider (a splitter) employing the microstrip transmission line structure of one embodiment, and the basic layout of the Wilkinson power divider operating at a center frequency of 1 GHz as an example of an operating frequency. Through FIG. 8*a* to FIG. 8*d*, the reference signs P1, P2 and P3 refer to three ports.

Figure 8B:
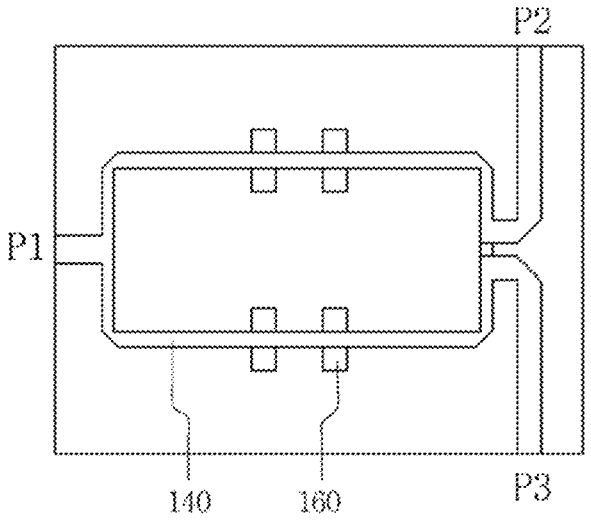
Figure 8C:
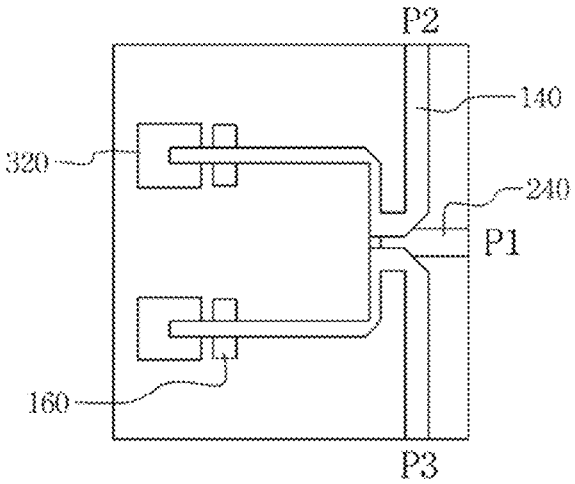
Figure 8D:
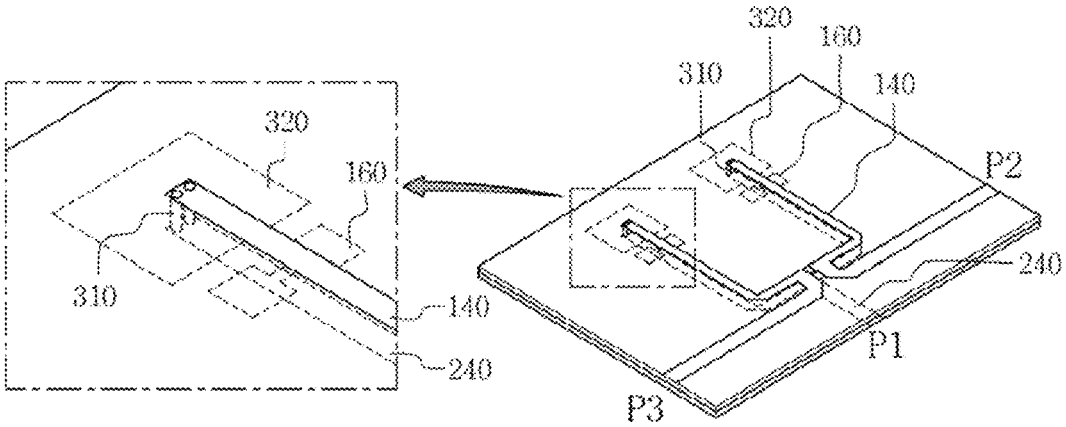

FIG. 8*a* illustrates a circuit employing a single-layered microstrip board structure, and FIG. 8*b* illustrates a circuit with a reduced size by inserting the defected ground structure 160 into the circuit of FIG. 8*a*. The common defected ground structure (DGS) and the double microstrip transmission line structure are applied to the circuit of FIG. 8*b*, so that it is possible to obtain a circuit with a significantly reduced size as illustrated in FIG. 8*c*. The important thing is that the performance of the circuit is similarly maintained although the size of the circuit is reduced. FIG. 8*d* is an upper perspective view of FIG. 8*c* and an enlarged diagram of main elements, and suggestively illustrates the application of the defected ground structure (DGS) and the double microstrip transmission line structure. The circuit of FIG. 8*a* and the circuit of FIG. 8*c* perform the same function, but the circuit of FIG. 8*c* employing the defected ground structure (DGS) and the double microstrip transmission line structure has a size corresponding to about ½ of that of the circuit of FIG. 8*a*.

Figure 9A:
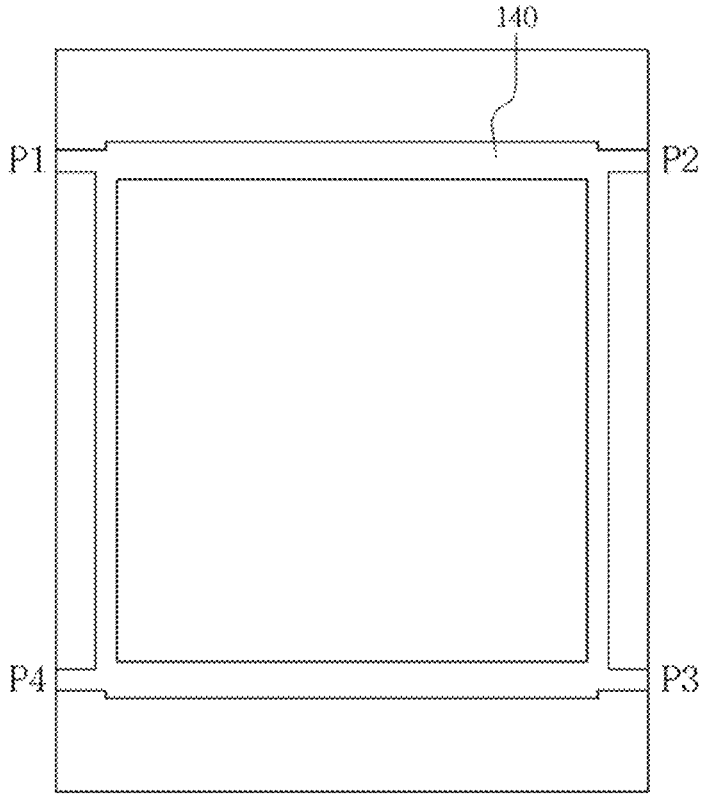

FIG. 9*a* illustrates a branch line hybrid coupler (BLHC) employing the microstrip transmission line structure of one embodiment, and the basic layout of the branch line hybrid coupler operating at a center frequency of 1 GHz as an example of an operating frequency.

Figure 9B:
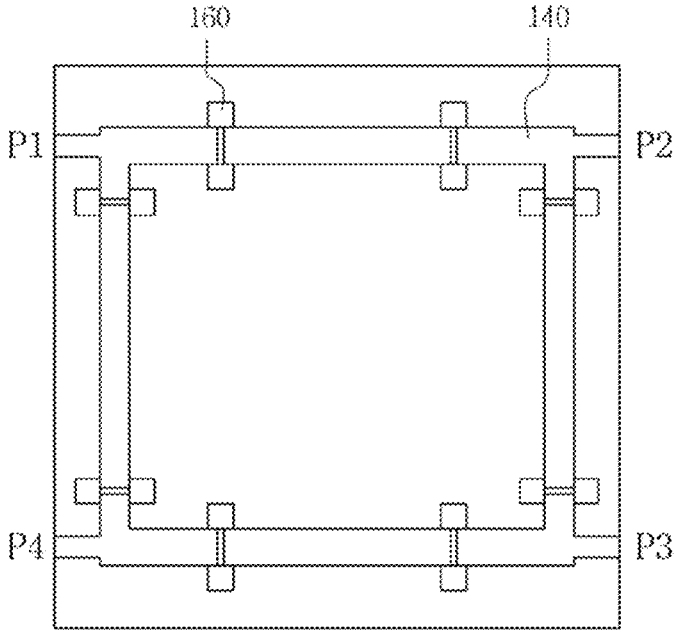
Figure 9C:
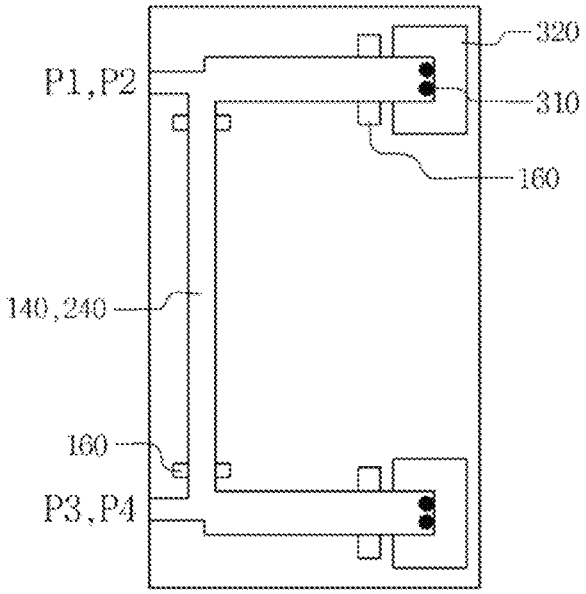
Figure 9D:
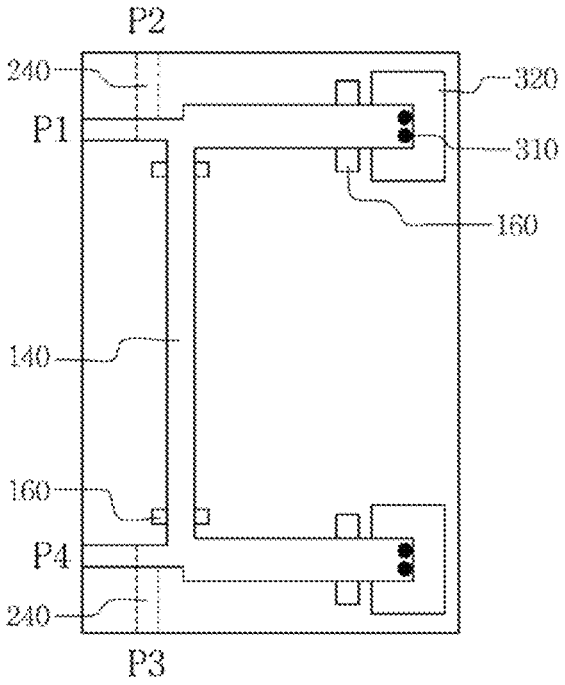

FIG. 9*a* illustrates a circuit employing a single-layered microstrip board structure, and FIG. 9*b* illustrates a circuit with a reduced size by inserting the defected ground structure 160 into the circuit of FIG. 9*a*. The microstrip transmission line structure of the one embodiment is applied to the circuit of FIG. 9*b*, so that it is possible to obtain a circuit with a significantly reduced size while maintaining substantially the same circuit performance as illustrated in FIG. 9*c*. FIG. 9*d* illustrates a modified layout in which ports P2 and P3 are bent at an angle of 90° to cross ports P1 and P4, respectively, in order to prevent the ports P1 to P4 from overlapping one another.

Figure 10A:
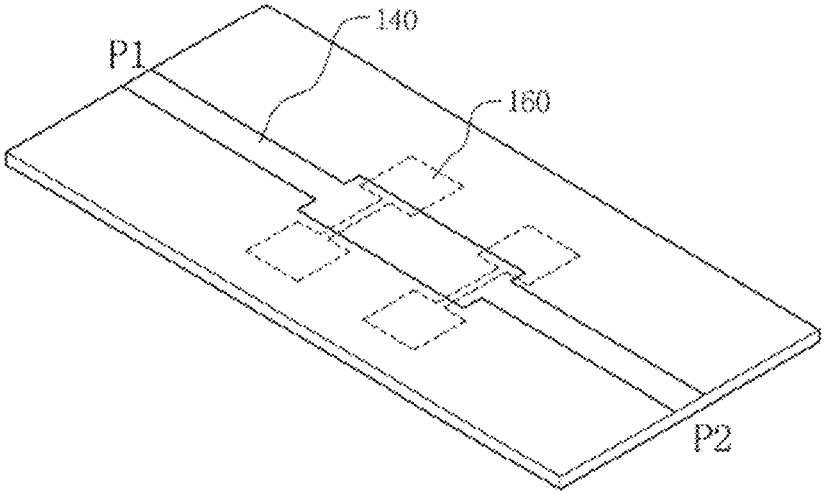

FIG. 10*a* illustrates a low pass filter (LPF) employing the microstrip transmission line structure of one embodiment, and the basic layout of the low pass filter operating at a cutoff frequency of 3 GHz as an example of an operating frequency.

Figure 10B:
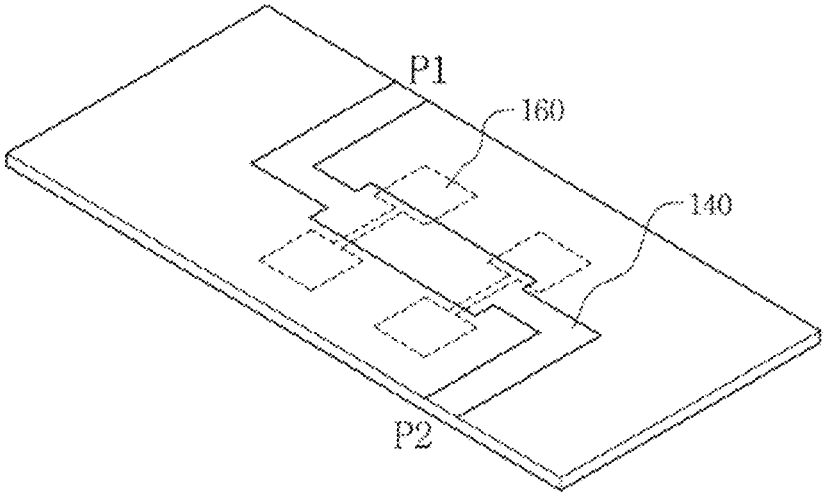
Figure 10C:
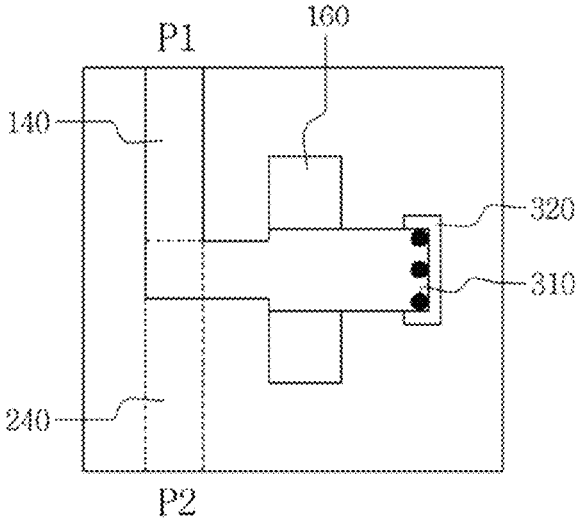

FIG. 10*b* illustrates a layout in which input/output ports P1 and P2 are directed to the opposite direction, differently from the layout of FIG. 10*a* including the defected ground structure (DGS) 160. This is for solving a problem that the ports overlap each other when the double microstrip transmission line structure is employed later. FIG. 10*a* or FIG. 10*b* illustrates a single-layered microstrip board structure. The common defected ground structure (DGS) and the double microstrip transmission line structure according to the technical idea of the one embodiment are employed, so that it is possible to obtain a circuit with a significantly reduced size while maintaining substantially the same circuit performance as illustrated in FIG. 10*c*. At this time, since the two ports P1 and P2 are directed to the opposite direction, it is convenient in an actual use.

Figure 11A:
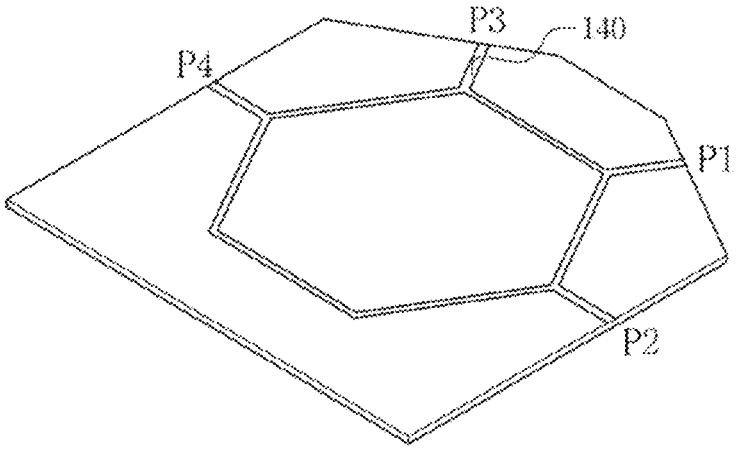

FIG. 11*a* illustrates a ring hybrid coupler or a rat-race coupler employing the microstrip transmission line structure of one embodiment, and the basic layout of a 180°-ring hybrid coupler operating at a center frequency of 2 GHz as an example of an operating frequency. Through FIG. 11*a* to FIG. 11*c*, the reference signs P1, P2, P3 and P4 refer to four ports.

Figure 11B:
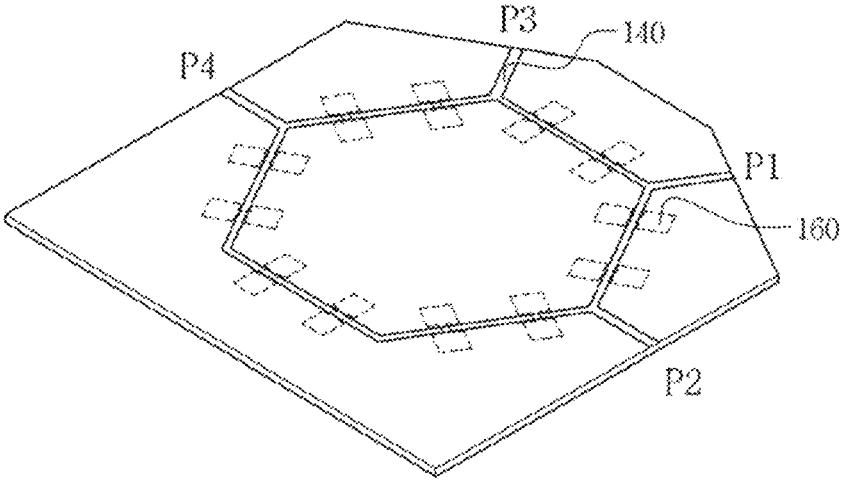
Figure 11C:
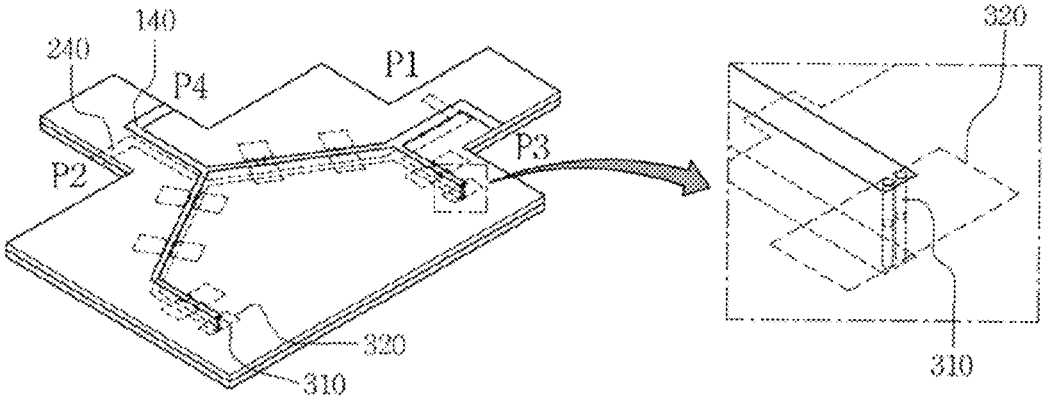

FIG. 11*b* illustrates a circuit with a reduced size by inserting the defected ground structure (DGS) 160 into the layout of FIG. 11*a*. FIG. 11*a* or FIG. 11*b* illustrates a single-layered microstrip board structure. The common defected ground structure (DGS) and the double microstrip transmission line structure according to the technical idea of the one embodiment are employed, so that it is possible to obtain a circuit with a significantly reduced size while maintaining substantially the same circuit performance as illustrated in FIG. 11*c*.

Figure 12A:
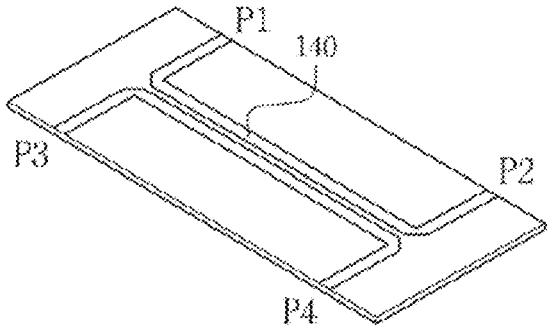

FIG. 12*a* illustrates a coupled line coupler or a directional coupler employing the microstrip transmission line structure of one embodiment, and the basic layout of a 15 dB coupled line coupler operating at a center frequency of 1.5 GHz as an example of an operating frequency.

Figure 12B:
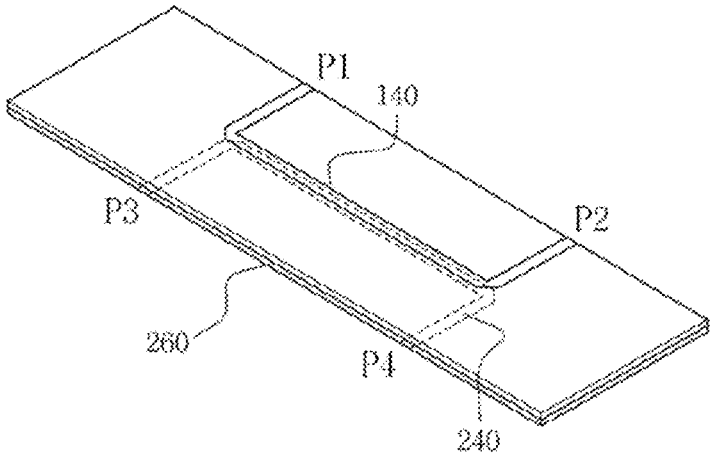

FIG. 12*a* illustrates a single-layered microstrip board structure, and signal coupling between signal line patterns 140 of two transmission lines is performed on the same plane, wherein the signal coupling represents the unique characteristics of the coupled line coupler. FIG. 12*b* is a diagram before the technical idea of the one embodiment is employed, and illustrates a structure in which a signal line pattern 140 of a transmission line between ports P1 and P2 is formed on an upper board of the double microstrip transmission line structure, and a signal line pattern 240 of a transmission line between ports P3 and P4 is formed on a lower board thereof. In FIG. 12*b*, since ground conductive surfaces of the upper and lower boards brought into contact with each other serve as ground surfaces with respect to the upper and lower signal line patterns 140 and 240, but the upper and lower signal line patterns 140 and 240 are completely isolated from each other, no signal coupling is performed between the upper and lower signal line patterns 140 and 240.

Figure 12C:
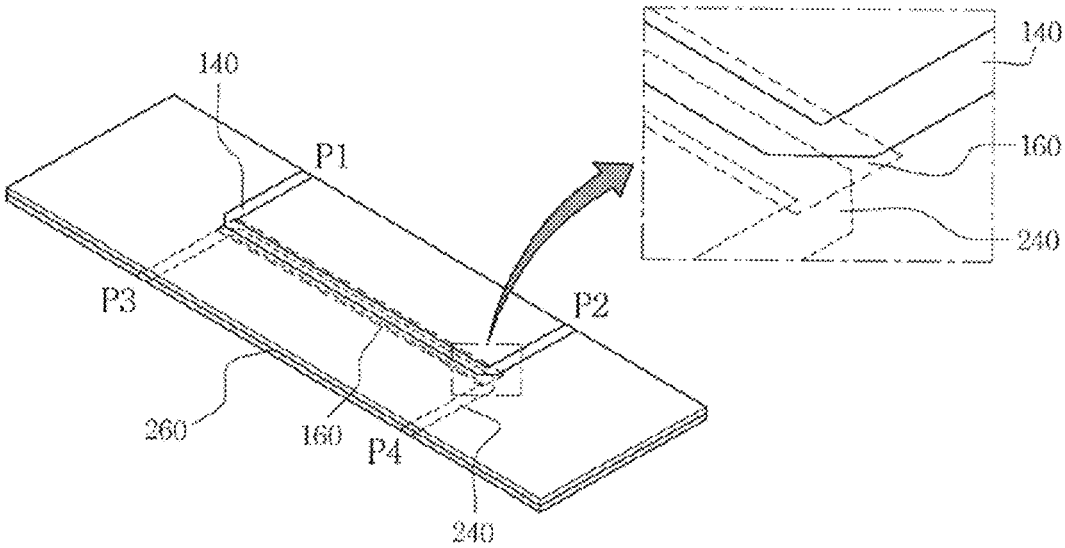

If the technical idea of the one embodiment is applied to the structure of FIG. 12*b*, that is, an elongated defected ground structure 160 having a rectangular shape is inserted into the common ground conductive layer 260 of the double microstrip transmission line structure, signal coupling phenomenon occurs between upper and lower microstrip transmission lines through the defected ground structure (DGS) 160. In addition, due to an increase in an electrical length, which is one of the basic effects of the defected ground structure (DGS) 160, it is possible to obtain a circuit with a reduced size while maintaining substantially the same circuit performance as illustrated in FIG. 12*c*.

The same effect is obtained in the double microstrip transmission line structure commonly employing the defected ground structure (DGS), regardless of the presence or absence of the signal via hole 310 and the ground window 320 for passing through the signal via hole. That is, the signal via hole 310 and the ground window 320 for passing through the signal via hole may be selectively used in a circuit configuration process, or vice versa.

The Wilkinson power divider, the 90°-branch line hybrid coupler, the 180°-ring hybrid coupler and the like may be designed using the double microstrip transmission line structure having the defected ground structure (DGS), which corresponds to the technical idea of the one embodiment, such that a power dividing ratio between two output ports is 1:1 (symmetric, equal division) or asymmetric. Furthermore, FIGS. 12*a* to 12*c* according to the one embodiment illustrate a directional coupler having a coupling coefficient of 15 dB, that is, a coupling (S31) value of −15 dB. However, it is possible to allow the directional coupler to have various coupling coefficients by changing the line width and length of the double microstrip transmission line, and the shape and size of the defected ground structure (DGS).

According to the present disclosure, a double microstrip transmission line having a common defected ground structure (DGS) is formed in a novel structure, the length of the microstrip transmission line is minimized through the novel structure in a circuit design, and the sizes of various wireless circuits are significantly reduced using the structure of the microstrip transmission line, so that the degree of integration may be improved.

The above-mentioned embodiments are only partial examples employing the technical idea of the one embodiment, and can be variously applied in a miniaturization design of high frequency circuits/parts for various wireless systems such as mobile communication systems, satellite communication systems, or broadcasting systems. That is, in the double microstrip transmission line structure, a method for forming a circuit by inserting defected ground structures (DGSs) having various shapes into a common ground conductive surface can be variously modified without departing from the core.

While the exemplary embodiments have been shown and described, it will be understood by those skilled in the art that various changes in form and details may be made thereto without departing from the spirit and scope of the present disclosure as defined by the appended claims.

In addition, many modifications can be made to adapt a particular situation or material to the teachings of the present disclosure without departing from the essential scope thereof. Therefore, it is intended that the present disclosure not be limited to the particular exemplary embodiments disclosed as the best mode contemplated for carrying out the present disclosure, but that the present disclosure will include all embodiments falling within the scope of the appended claims.

What is claimed is:

1. A method for forming a wireless circuit device of double microstrip transmission line structure, the method comprising:

designing a circuit layout of single-layered board structure with a defected ground structure (DGS) provided on a bottom ground surface thereof; and folding the designed circuit layout in half to change the single-layered board structure into a double board structure; and wherein the double board structure formed by folding the designed circuit layout includes a first signal line pattern, a first dielectric layer formed on the first signal line pattern, a common ground conductive layer formed on the first dielectric layer and having the defected ground structure (DGS), a second dielectric layer formed on the common ground conductive layer and a second signal line pattern formed on the second dielectric layer.

* * * * *